US008947193B2

(12) United States Patent
Rinner

(10) Patent No.: US 8,947,193 B2
(45) Date of Patent: Feb. 3, 2015

(54) RESISTANCE COMPONENT AND METHOD FOR PRODUCING A RESISTANCE COMPONENT

(75) Inventor: Franz Rinner, Deutschlandsberg (AT)

(73) Assignee: Epcos AG, Munich (DE)

( * ) Notice: Subject to any disclaimer, the term of this patent is extended or adjusted under 35 U.S.C. 154(b) by 16 days.

(21) Appl. No.: 13/819,237

(22) PCT Filed: Aug. 31, 2011

(86) PCT No.: PCT/EP2011/065047

§ 371 (c)(1),
(2), (4) Date: Apr. 26, 2013

(87) PCT Pub. No.: WO2012/031963

PCT Pub. Date: Mar. 15, 2012

(65) Prior Publication Data

US 2013/0207770 A1 Aug. 15, 2013

(30) Foreign Application Priority Data

Sep. 9, 2010 (DE) ..... 10 2010 044 856

(51) Int. Cl.

| | |
|---|---|
| ***H01C 7/10*** | (2006.01) |
| ***H01C 7/18*** | (2006.01) |
| ***H01C 1/14*** | (2006.01) |
| ***H01C 1/146*** | (2006.01) |
| ***H01C 7/04*** | (2006.01) |
| ***H01C 7/00*** | (2006.01) |
| ***H01C 17/00*** | (2006.01) |

(52) U.S. Cl.

CPC ..... *H01C 7/18* (2013.01); *H01C 1/1413* (2013.01); *H01C 1/146* (2013.01); *H01C 7/041* (2013.01); *H01C 7/008* (2013.01); *H01C 17/00* (2013.01)

USPC ..... 338/22 R

(58) Field of Classification Search

CPC ..... H01C 7/18; H01C 7/008; H01C 17/00

USPC ..... 338/22 R

See application file for complete search history.

(56) References Cited

U.S. PATENT DOCUMENTS

| | | | | |
|---|---|---|---|---|
| 5,119,062 | A | 6/1992 | Nakamura et al. | |
| 5,324,986 | A * | 6/1994 | Ueno et al. | 257/701 |
| 6,147,587 | A | 11/2000 | Hadano et al. | |
| 6,163,246 | A * | 12/2000 | Ueda et al. | 338/331 |
| 6,184,769 | B1 | 2/2001 | Nakamura et al. | |

(Continued)

FOREIGN PATENT DOCUMENTS

| | | | |
|---|---|---|---|
| DE | 40 36 997 | A1 | 5/1991 |
| DE | 199 12 851 | A1 | 10/1999 |

(Continued)

*Primary Examiner* — Kyung Lee

(74) *Attorney, Agent, or Firm* — Slater & Matsil, L.L.P.

(57) ABSTRACT

A resistance component includes a stack of ceramic layers and inner electrodes. Inner electrodes of a first type are electrically conductively connected to a first external contact and inner electrodes of a second type are electrically conductively connected to a second external contact. The inner electrodes of the first type are arranged such that there is no overlap with the inner electrodes of the second type. An inner electrode of a third type, which is electrically conductively connected neither to the first external contact nor to the second external contact, at least partially overlaps the inner electrodes of the first type and the inner electrodes of the second type.

14 Claims, 2 Drawing Sheets

(56) References Cited

U.S. PATENT DOCUMENTS

| | | | | |
|---|---|---|---|---|
| 6,608,547 | B1 * | 8/2003 | Greier et al. | 338/21 |
| 7,135,955 | B2 | 11/2006 | Feichtinger et al. | |
| 7,696,677 | B2 * | 4/2010 | Ito et al. | 310/365 |
| 2006/0279172 | A1 | 12/2006 | Ito et al. | |
| 2007/0175019 | A1 | 8/2007 | Rosc et al. | |
| 2008/0165468 | A1 | 7/2008 | Berolini et al. | |
| 2010/0214054 | A1 | 8/2010 | Kobayashi et al. | |

FOREIGN PATENT DOCUMENTS

| | | | |
|---|---|---|---|
| DE | 10 2010 001 921 | A1 | 9/2010 |
| EP | 1 679 723 | A1 | 7/2006 |
| EP | 1 451 833 | B1 | 11/2007 |
| JP | 2260605 | A | 10/1990 |
| JP | 8279437 | A | 10/1996 |
| JP | 10199709 | A | 7/1998 |
| JP | 11191506 | A | 7/1999 |
| JP | 2000353636 | A | 12/2000 |
| JP | 200215941 | A | 1/2002 |
| JP | 200275780 | A | 3/2002 |
| JP | 2002134304 | A | 5/2002 |
| JP | 2003272902 | A | 9/2003 |
| JP | 2003272903 | A | 9/2003 |
| JP | 2008211181 | A | 9/2008 |
| WO | WO 01/82314 | A1 | 11/2001 |
| WO | 2005043556 | A1 | 5/2005 |

* cited by examiner

RESISTANCE COMPONENT AND METHOD FOR PRODUCING A RESISTANCE COMPONENT

This patent application is a national phase filing under section 371 of PCT/EP2011/065047, filed Aug. 31, 2011, which claims the priority of German patent application 10 2010 044 856.7, filed Sep. 9, 2010, each of which is incorporated herein by reference in its entirety.

TECHNICAL FIELD

Embodiments of the present invention relate to a resistance component and a method for producing a resistance component.

BACKGROUND

European Patent Publication No. EP 1 451 833 B1 describes a resistance component having a negative temperature coefficient.

SUMMARY OF THE INVENTION

A resistance component comprising a stack composed of ceramic layers and internal electrodes arranged therebetween is specified. In order to make electrical contact with the internal electrodes, external contacts can be fixed to the exterior of the stack. Resistance components of this type can be embodied as NTC thermistors, for example, and are used for temperature measurement, for example.

Embodiments of the invention specify a geometry of a resistance component, in particular an internal and external electrode arrangement of a resistance component, which has improved properties.

A resistance component having a main body which comprises a stack composed of ceramic layers and internal electrodes arranged therebetween is specified. The resistance component comprises a first and a second external contact.

The external contacts are preferably arranged on two opposite side faces of the component. By way of example, the external contacts are produced by dipping the component into a conductive paste and can therefore have caps or capped regions. The external contacts then are arranged on a plurality of side faces of the main body in an edge-embracing fashion and the caps constitute the edge-embracing regions of the external contact.

The resistance component comprises internal electrodes of a first type, which are electrically conductively connected to the first external contact. Furthermore, the resistance component comprises internal electrodes of a second type, which are electrically conductively connected to the second external contact. Both the internal electrodes of the first type and the internal electrodes of the second type are preferably arranged in a stacked fashion.

Furthermore, the internal electrodes of the first type are arranged in a manner free of overlap with the internal electrodes of the second type. Consequently, a gap is formed between the internal electrodes of the first type and the internal electrodes of the second type, wherein a current that flows from the first external contact to the second external contact can flow from the internal electrodes of the first type via the ceramic layers to the internal electrodes of the second type. The gap is delimited on two sides respectively by edges of the internal electrodes of the first type and of the second type, where the term edges denotes the ends of the internal electrodes which face in the direction of the opposite internal electrodes.

By reducing or enlarging the gap, it is possible to alter the electrical properties of the resistance component in a targeted manner. By way of example, reducing the gap between the internal electrodes of the first type and the internal electrodes of the second type brings about a reduction of the resistance of the component.

Furthermore, the resistance component comprises at least one internal electrode of a third type, which is electrically conductively connected neither to the first nor to the second external contact.

Preferably, the internal electrode of the third type at least partly overlaps the internal electrodes of the first type and the internal electrodes of the second type.

A current that flows from the first external contact to the second external contact can flow from the first external contact via the internal electrodes of the first type, via the ceramic layers and via the internal electrode of the third type and the ceramic layers to the internal electrodes of the second type and to the second external contact.

By altering the distance between the internal electrode of the third type and the internal electrodes of the first and of the second type or by enlarging or reducing the overlap region, it is possible to set the electrical properties of the resistance component, such as, for example, the resistance of the component, in a targeted manner.

For each internal electrode of the third type, at least three internal electrodes of the first type and three internal electrodes of the second type are provided.

In the case of the component described here, a first portion of the current flowing from the first to the second external contact flows from the first external contact via the internal electrodes of the first type and the edges of the internal electrodes of the first type directly via the gap to the edges of the internal electrodes of the second type and via the internal electrodes of the second type to the second external contact.

A second portion of the current flows from the first external contact via the areas of the internal electrodes of the first type and via the area of the internal electrode of the third type to the areas of the internal electrodes of the second type and to the second external contact.

In comparison with internal electrode arrangements of resistance components wherein, for each internal electrode of the third type, only in each case one or two internal electrodes of the first and second types are provided, in the case of the resistance component described here the first portion of the current, which flows directly from the internal electrodes of the first type to the internal electrodes of the second type via the gap without flowing via the internal electrode of the third type, is increased in comparison with the second portion of the current, which flows via the internal electrode of the third type.

It has been found that currents that flow perpendicularly to the main area of the component, that is to say in the stacking direction, are particularly sensitive to layer thickness fluctuations of the ceramic layers. A current flows in the stacking direction essentially if the current flows from the internal electrodes of the first type via the internal electrode of the third type to the internal electrodes of the second type.

In the case of currents that flow in a lateral direction, that is to say perpendicularly to the stacking direction or parallel to the main area of the component, that is to say those currents which flow directly via the gap, this effect likewise occurs, but with a different sign.

The internal electrode arrangement described here optimizes the ratio of the first portion of the current, that is to say of the current flowing in a lateral direction, to the second portion of the current, that is to say the current flowing in the stacking direction, such that it is possible to reduce adverse effects of manufacturing-dictated fluctuations as a result of variation of ceramic layer thicknesses in the case of different components. Thus, in comparison with known components, in the case of the component described here, even in the case of layer thickness fluctuations of the ceramic layers from component to component, a substantially identical predefined desired resistance can be achieved in the case of these components.

The internal electrode of the third type is preferably in each case at a substantially identical distance from two opposite side faces of the component.

In this case, here and hereinafter, "identical" or "substantially identical" means that the deviations are in the range of the tolerances of the production method. By way of example, the internal electrode of the third type can be at a distance from a side face of the component which deviates from the distance between the internal electrode of the third type and the opposite side face by less than or equal to 10 μm.

Preferably, all the internal electrodes of the first type are at a substantially identical distance from the respectively opposite internal electrodes of the second type, wherein distance is taken to mean the lateral distance between an edge of an internal electrode of the first type and an edge of an opposite internal electrode of the second type. Since all internal electrodes of the first type are at a substantially identical distance from the respectively opposite internal electrodes of the second type, a gap having a constant size arises between the internal electrodes of the first type and the internal electrodes of the second type.

Furthermore, a first and a second internal electrode of the first type and a first and a second internal electrode of the second type can function as shielding electrodes for shielding the rest of the internal electrodes from regions of the external contacts. In this case, the shielding is primarily effected with regard to the caps of the external contacts, that is to say that undesirable influences of the capped, edge-embracing regions of the external contacts on the electrical properties of the resistance component can be minimized.

By way of example, in each case two internal electrodes of the first type and two internal electrodes of the second type can be arranged above the internal electrode of the third type. On the other side of the internal electrode of the third type, likewise in each case two internal electrodes of the first type and two internal electrodes of the second type can be arranged below the internal electrode of the third type.

In accordance with one embodiment, the resistance component is symmetrical with regard to the internal electrode of the third type. Preferably, the component is symmetrical with respect to three mutually perpendicular planes. That means that three planes can be assigned to the resistance component, said planes being perpendicular to one another and the component being symmetrical with respect to said planes.

In a further embodiment, the resistance component comprises exactly one internal electrode of the third type and at least in each case three internal electrodes of the first type and of the second type.

In one embodiment, the internal electrodes of the first type and the internal electrodes of the second type all have an identical length substantially corresponding to half a length of the internal electrode of the third type.

In a further embodiment, the internal electrodes of the first type, of the second type and of the third type have a substantially identical width. Furthermore, the distance between the internal electrodes of the first type and the internal electrodes of the second type can substantially correspond to twice the distance between the internal electrode of the third type and a side face of the component from which the internal electrodes of the first or second type project into the main body.

Preferably, the internal electrodes of the first type and the internal electrodes of the second type all have an identical area substantially corresponding to half the area of the internal electrode of the third type.

The above-described features with regard to the length, width, area and distances of the respective internal electrodes afford the advantage that the same printing mask can be used within the production process for the resistance component in the course of printing all the internal electrodes.

In accordance with one embodiment, the resistance component has the form of a parallelepiped having a length l, a width b and a height h. For the electrical resistance $R_{25}$ of the component at a nominal temperature of 25° C., for the resistivity ρ of the ceramic layers, the length l, width b and height h of the component, the following mathematical relationship holds true:

$$0.10 \leq (R_{25} \cdot b \cdot h)/(\rho \cdot l) \leq 0.20.$$

In one preferred embodiment, the following holds true:

$$0.14 \leq (R_{25} \cdot b \cdot h)/(\rho \cdot l) \leq 0.16.$$

In one particularly preferred embodiment, the following holds true:

$$(R_{25} \cdot b \cdot h)/(\rho \cdot l) = 0.15.$$

Preferably, the width b of the component substantially corresponds to half the length of the component.

In a further embodiment, each internal electrode is at a substantially identical distance from the closest internal electrode in the stacking direction.

In an alternative embodiment, the internal electrodes of the first type and of the second type are at different distances from adjacent internal electrodes in the stacking direction.

Preferably, the resistance component described is an NTC thermistor, that is to say a resistance component having a negative temperature coefficient. In the case of an NTC thermistor, the current that flows through the ceramic layers is conducted better at high temperatures than at low temperatures.

Furthermore, a method for producing a resistance component described above is specified.

In this case, the internal electrodes are applied on a ceramic green sheet by means of a printing method that uses a conductive paste. When applying the internal electrodes, the same printing mask is used for all the internal electrodes. By virtue of only one printing mask being used, the process for producing a resistance component described here can be considerably simplified.

Preferably, the at least one internal electrode of the third type is applied in a manner offset by half a length of the component with respect to the internal electrodes of the first type and with respect to the internal electrodes of the second type.

After the fired ceramic layers have been cut, this gives rise to a resistance component according to the invention, wherein the internal electrodes of the first type and of the second type all have an identical area corresponding to half the area of the internal electrode of the third type arranged in the center of the component.

BRIEF DESCRIPTION OF THE DRAWINGS

The resistance component specified and advantageous configurations will be explained below with reference to schematic figures, in which.

DETAILED DESCRIPTION OF ILLUSTRATIVE EMBODIMENTS

Figure 1:
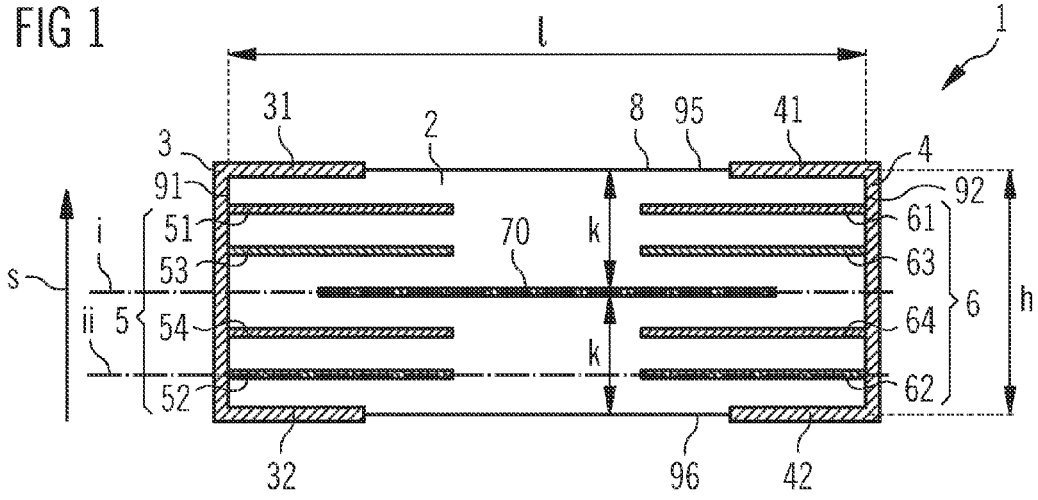
FIG. 1 shows a cross section of a resistance component according to the invention.

FIG. 1 shows a cross section of a resistance component 1 having a main body 8 comprising ceramic layers 2 and various internal electrodes 5, 6, 70. The resistance component 1 comprises a first and a second capped external contact 3, 4 on two opposite side faces 91, 92 of the main body 8. In this case, four internal electrodes 5 of a first type are electrically conductively connected to the first external contact 3 and four internal electrodes 6 of a second type are electrically conductively connected to the second external contact 4. Furthermore, the main body 8 of the resistance component 1 has an internal electrode 70 of a third type, which is electrically conductively connected neither to the first 3 nor to the second 4 external contact.

The internal electrodes 5 of the first type connected to the first external contact 3 and the internal electrodes 6 of the second type connected to the second external contact 4 are situated opposite one another in each case in pairs. That means that in each case one internal electrode 51, 52, 53, 54 of the first type and one internal electrode 61, 62, 63, 64 of the second type are arranged in an identical imaginary horizontal sectional plane that is parallel to an underside of the main body 8.

Furthermore, the internal electrodes 5 of the first type and the internal electrodes 6 of the second type are spaced apart from one another, that is to say that they do not touch one another and have no overlap. Consequently, a gap is formed between the internal electrodes 5 of the first type and the internal electrodes 6 of the second type.

On the other hand, both the internal electrodes 5 of the first type and the internal electrodes 6 of the second type overlap the internal electrodes 70 of the third type arranged centrally in the main body 8.

In the exemplary embodiment in accordance with FIG. 1, in each case two internal electrodes 51, 53 of the first type and two internal electrodes 61, 63 of the second type are arranged above the internal electrode 70 of the third type. On the other side of the internal electrode 70, two internal electrodes 52, 54 of the first type and two internal electrodes 62, 64 of the second type are arranged below the internal electrode 70 of the third type.

Preferably, the internal electrode 70 of the third type is in each case at the same distance from the first 3 and second 4 external contact.

By virtue of the arrangement at the outer edge of the main body 8, the internal electrodes 51, 52, 61, 62 can additionally act as shielding electrodes in that they shield the rest of the internal electrodes from the influence of the capped external contacts 3, 4. In this case, they primarily effect shielding from the regions of the external contacts 3, 4 which at least partly cover the side faces 95 and 96 and are approximately parallel to the internal electrodes 5, 6, 70.

In the exemplary embodiment in accordance with FIG. 1, the internal electrode 70 of the third type is at the same distance from in each case two opposite side faces of the component 1. Furthermore, each internal electrode is at the same distance from the closest internal electrode in the vertical direction, that is to say that the internal electrodes are spaced apart identically.

The resistance component 1 is formed symmetrically with regard to the internal electrode 70 of the third type. Furthermore, the component 1 is symmetrical with respect to three mutually perpendicular planes. In other words, three planes can be assigned to the resistance component 1, said planes being perpendicular to one another and the component being symmetrical with respect to said planes.

A resistance component in accordance with FIG. 1 is preferably an NTC thermistor component. The component has, for example, a height of 750 μm, a width of 750 μm and a length of 1520 μm. The ceramic layers 2 have, for example, a resistivity of 24.3 Ωm and the electrical resistance R25 of the component at a nominal temperature of 25° C. is 10 kΩ.

The internal electrode 70 of the third type arranged in the center of the component has, for example, a width of 390 μm and a length of 1084 μm. The internal electrodes 5, 6 of the first and second types projecting from the external contacts 3, 4 into the main body 8 of the component have a width of 390 μm and a length of 524 μm. The size of the gap between the internal electrodes 5 of the first type and the internal electrodes 6 of the second type is 436 μm. The internal electrodes are at a distance of 125 μm from the closest internal electrodes in the stacking direction. The distance between the first external contact 3 and the second external contact 4 is 920 μm.

In the case of a further resistance component according to the invention, a glazing is situated above the component. In this embodiment, the external contacts 3, 4 have no direct contact with the ceramic layers 2, since the glazing is arranged between the external contacts 3, 4 and the ceramic layers 2. As a result, it is possible to reduce undesirable influences of the external contacts 3, 4 on the electrical properties of the component, in particular undesirable influences of the capped regions 31, 32, 41, 42 of the external contacts 3, 4.

In the case of such a resistance component having glazing, the internal electrode 70 of the third type arranged in the center of the component has a width of 400 μm and a length of 1085 μm. The distance between the internal electrodes 5 of the first type and the internal electrodes 6 of the second type, that is to say the size of the gap between the internal electrodes 5 of the first type and the internal electrodes 6 of the second type, is 435 μm.

Figure 2:
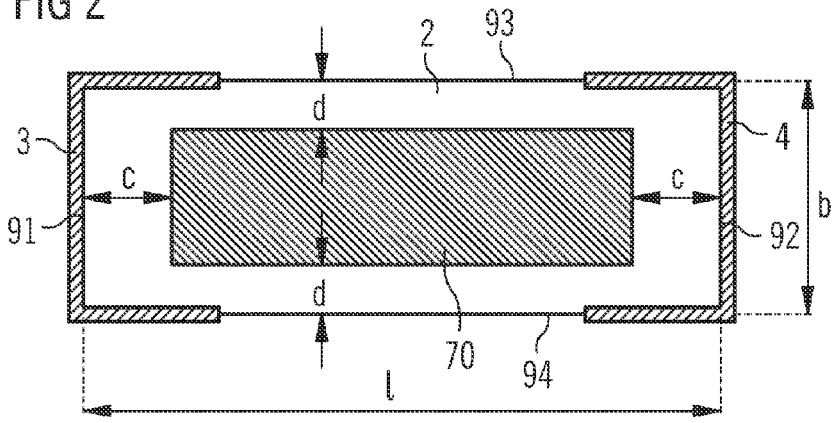
FIGS. 2 and 3 show plan views of different layers of a resistance component according to the invention.

FIG. 2 shows a plan view of the resistance component 1 according to the invention in accordance with FIG. 1, the section through the plane i being illustrated here. The internal electrode 70 of the third type is embodied in a rectangular fashion. It is arranged centrally in the resistance component, that is to say that the internal electrode 70 of the third type is in each case at the same distance c and d from two opposite side faces 91 and 92 and respectively 93 and 94 of the component 1. The internal electrode 70 of the third type has a width of 390 μm and a length of 1084 μm, for example.

Figure 3:
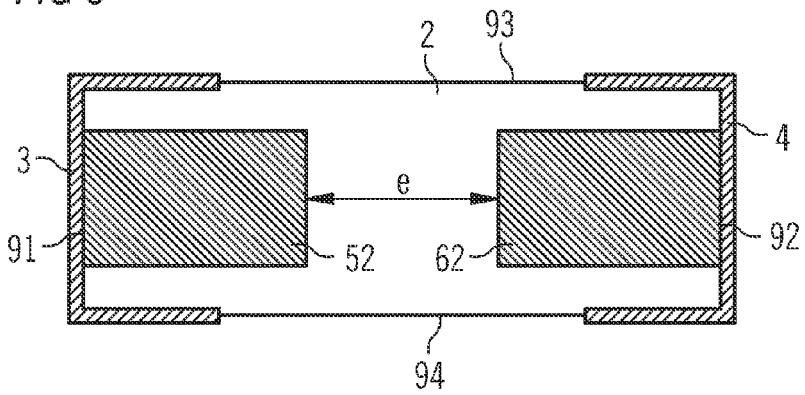

FIG. 3 shows a further plan view of the component 1 according to the invention in accordance with FIG. 1. The section through plane ii is illustrated in this case. The internal electrode 52 of the first type is electrically conductively connected to the external contact 3. The internal electrode 62 of the second type is electrically conductively connected to the second external contact 4. The two internal electrodes 52 and 62 are spaced apart from one another. They are at a distance e of 436 μm, for example.

Preferably, all the internal electrodes 5 of the first type are at the same distance e from the respectively opposite internal electrodes 6 of the second type.

In this case, it is particularly advantageous if the distance e corresponds to twice the distance 2*c* between the central internal electrode 70 and the side face 91 and respectively 92 of the resistance component 1. This will become clear below in connection with the printing of the internal electrodes during the production of a component according to the invention.

In the exemplary embodiment in accordance with FIGS. 1, 2 and 3, the width of the two internal electrodes 53 and 63 with a width of 390 μm, for example, corresponds to the width of the internal electrode of the first type.

The length of the internal electrodes 5 of the first type preferably corresponds to the length of the internal electrodes 6 of the second type.

It is particularly preferred if the length of the internal electrodes 5, 6 of the first and second types corresponds to half a length of the central internal electrode 70 of the third type.

As a result, an identical printing mask can be used for all the internal electrodes during the production of the resistance component. In the case of the internal electrode 70 of the third type, the printing is effected merely in a manner offset by half a component length l/2.

Figure 4:
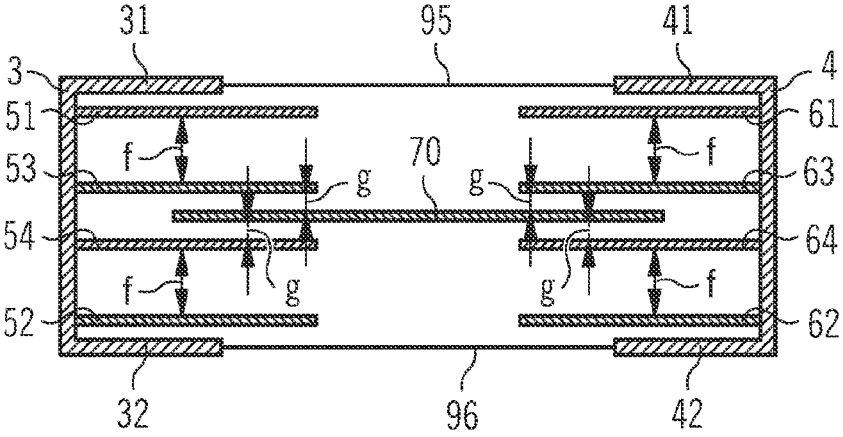
FIGS. 4 and 5 show cross sections of further embodiments of a resistance component according to the invention.

FIG. 4 shows a cross section of a resistance component according to the invention, wherein, unlike in FIG. 1, the internal electrodes 5 of the first type and the internal electrodes 6 of the second type are in each case spaced apart differently. The internal electrodes 51, 52 of the first type and 61, 62 of the second type are at a comparatively large distance f from the closest internal electrodes 53, 54 and 63, 64 in the vertical direction. By contrast, the internal electrodes 53, 54 of the first type and 63, 64 of the second type are at a comparatively small distance h from the internal electrode 70 of the third type.

By virtue of the altered distance between the internal electrodes, it is possible, for example, to vary the electrical resistance $R_{25}$ of the component 1 at a nominal temperature of 25° C.

Furthermore, as a result of a small distance between the internal electrodes 51, 52, 61, 62 and the caps 31, 32, 41, 42 of the external contacts 3, 4, a particularly effective shielding from the influence of the capped regions of the first and second external contacts can be effected by the internal electrodes 51, 52 of the first type and 61, 62 of the second type.

Figure 5:
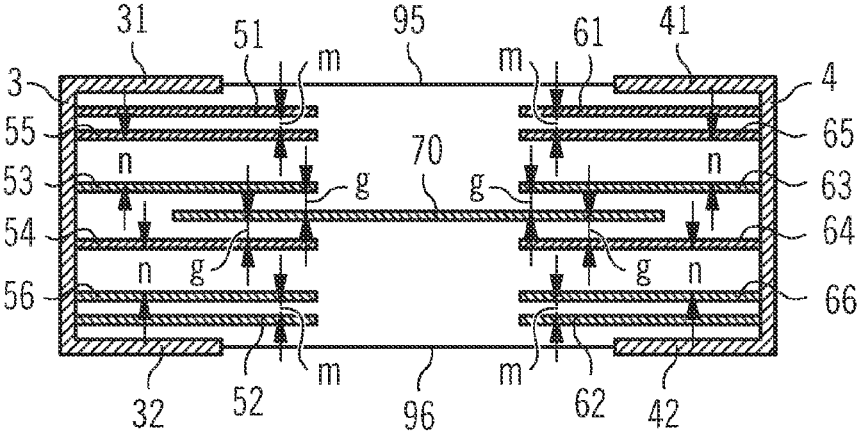

FIG. 5 shows a further embodiment, wherein a respective further internal electrode 55, 56, 65, 66 is arranged between the first 51 and third 53 internal electrode of the first type, between the second 52 and fourth 54 internal electrode of the first type, between the first 61 and third 63 internal electrode of the second type and between the second 62 and fourth 64 internal electrode of the second type.

Three mutually perpendicular planes can once again be assigned to the resistance component 1 in accordance with FIG. 5, the component 1 being symmetrical with respect to said planes.

The distance n, that is to say the respective distance between the internal electrodes 53, 54, 63, 64 and the internal electrodes 55, 56, 65, 66, is 150 μm. The distances m and g, that is to say the distances between the internal electrodes 51, 52, 61, 62 and the internal electrodes 55, 56, 65, 66 and respectively between internal electrodes 53, 54, 63, 64 and the free electrode 70, are in each case 75 μm.

By increasing the number of internal electrodes of the first type and of the second type, it is possible, for example, to vary the electrical resistance $R_{25}$ of the component 1 at a nominal temperature of 25° C. or to adapt it to different ceramic materials.

The invention is not restricted to the exemplary embodiments by the description on the basis of said exemplary embodiments, but rather encompasses any novel feature and also any combination of features. This includes, in particular, any combination of features in the patent claims, even if this feature or this combination itself is not explicitly specified in the patent claims or exemplary embodiments.

The invention claimed is:

1. A resistance component, comprising:

a stack composed of ceramic layers;

a first external contact;

a second external contact;

internal electrodes of a first type, which are electrically conductively connected to the first external contact;

internal electrodes of a second type, which are electrically conductively connected to the second external contact; and an internal electrode of a third type, which is electrically conductively connected to neither the first external contact nor the second external contact;

wherein the internal electrodes of the first type are arranged in a manner free of overlap with the internal electrodes of the second type;

wherein the internal electrode of the third type at least partly overlaps the internal electrodes of the first type and the internal electrodes of the second type; and wherein, for each internal electrode of the third type, at least three internal electrodes of the first type and three internal electrodes of the second type are provided, wherein the resistance component is an NTC thermistor component and wherein the mathematical relationship $$0.10 \leq (R_{25} \cdot b \cdot h)/(\rho \cdot l) \leq 0.20$$

holds true for the component, where l is a length of the component, b is a width of the component, h is a height of the component, $R_{25}$ is an electrical resistance of the component at a nominal temperature of 25° C. and ρ is a resistivity of the ceramic layers.

2. The component according to claim 1, wherein the first and second external contacts are arranged on opposite side faces of the component.

3. The component according to claim 1, wherein the internal electrode of the third type at a substantially identical distance from two opposite side faces of the component.

4. The component according to claim 1, wherein all the internal electrodes of the first type are at a substantially identical distance from the respectively opposite internal electrodes of the second type.

5. The component according to claim 1, wherein a first and a second internal electrode of the first type and a first and a second internal electrode of the second type are shielding electrodes configured to shield the rest of the internal electrodes from regions of the external contacts.

6. The component according to claim 5, wherein the first and second internal electrodes of the first type and the first and second internal electrodes of the second type are each at a greater distance from the closest internal electrode in a stacking direction than from a closest side face of the component.

7. The component according to claim 1, wherein two internal electrodes of the first type and two internal electrodes of the second type are arranged above the internal electrode of the third type, and two other internal electrodes of the first type and two other internal electrodes of the second type are arranged below the internal electrode of the third type.

8. The component according to claim 1, wherein the component is symmetrical with respect to three mutually perpendicular planes.

9. The component according to claim 1, wherein the internal electrodes of the first type and the internal electrodes of the second type all have an identical length substantially corresponding to half a length of the internal electrode of the third type.

10. The component according to claim 1, wherein the internal electrodes of the first type and the internal electrodes of the second type all have an identical area substantially corresponding to half the area of the internal electrode of the third type.

11. The component according to claim 1, wherein each internal electrode is at a substantially identical distance from the closest internal electrode in a stacking direction.

12. The component according to claim 1, wherein the component includes only one internal electrode of the third type.

13. A method for producing a component according to claim 1, wherein a printing mask is used to apply the internal electrodes, the printing mask being identical for all the internal electrodes.

14. The method according to claim 13, wherein the internal electrode of the third type is applied in a manner offset by half a length of the component with respect to the internal electrodes of the first type and with respect to the internal electrodes of the second type.

* * * * *